United States Patent [19]

Queiser et al.

[11] Patent Number: 4,671,925

[45] Date of Patent: Jun. 9, 1987

[54] METHOD FOR OPERATING A NUCLEAR REACTOR

[75] Inventors: Horst Queiser; Bernd Eckardt, both of Bruchköbel, Fed. Rep. of Germany

[73] Assignee: Kraftwerk Union Aktiengesellschaft, Mülheim/Ruhr, Fed. Rep. of Germany

[21] Appl. No.: 653,964

[22] Filed: Sep. 24, 1984

[30] Foreign Application Priority Data

Sep. 24, 1983 [DE] Fed. Rep. of Germany ..... 3334629

[51] Int. Cl.[4] ..... G21C 19/42

[52] U.S. Cl. ..... 376/310; 376/314; 55/66

[58] Field of Search ..... 376/310, 300, 301, 313, 376/314; 55/66

[56] References Cited

U.S. PATENT DOCUMENTS

| | | | |
|---|---|---|---|
| 3,125,760 | 3/1964 | Foster et al. | 376/314 X |
| 3,203,866 | 8/1965 | Lehmer et al. | 376/314 X |
| 3,404,067 | 10/1968 | Rendos | 376/310 X |
| 3,871,842 | 3/1975 | Queiser et al. | 376/314 X |
| 3,964,965 | 6/1976 | Kausz et al. | 376/310 |
| 4,043,865 | 8/1977 | Kausz et al. | 376/310 |
| 4,314,828 | 2/1982 | Saito et al. | 55/66 X |
| 4,416,850 | 11/1983 | Kodama et al. | 376/310 |
| 4,430,293 | 2/1984 | Callaghan et al. | 376/300 X |

*Primary Examiner*—Deborah L. Kyle
*Assistant Examiner*—John S. Maples
*Attorney, Agent, or Firm*—Herbert L. Lerner; Laurence A. Greenberg

[57] ABSTRACT

A method for operating a nuclear reactor having reactor coolant including an exhaust gas source and an exhaust gas system connected to the exhaust gas source, the exhaust gas system having at least one compressor connected to the exhaust gas source, a gas cooler connected to the compressor, a first reducing valve connected to the gas cooler, a switching valve connected to the first reducing valve, a moisture adsorber connected to the switching valve, a delay line normally connected in parallel with the moisture adsorber, a gas loop connected between the moisture adsorber and the compressor, a flue connection set at a given pressure during normal operation, and a second reducing valve connected between the delay line and the flue connection, includes interconnecting the delay line and the moisture adsorber in series, setting the flue connection to a pressure at least twice as high as the given pressure, reversing the switching valve thus allowing the exhaust gas to pass from the moisture adsorber to the delay line and then to the flue connection through the second reducing valve, upon the occurrence of a coolant displacement and increased exhaust gas production.

10 Claims, 2 Drawing Figures

METHOD FOR OPERATING A NUCLEAR REACTOR

Figure 1:
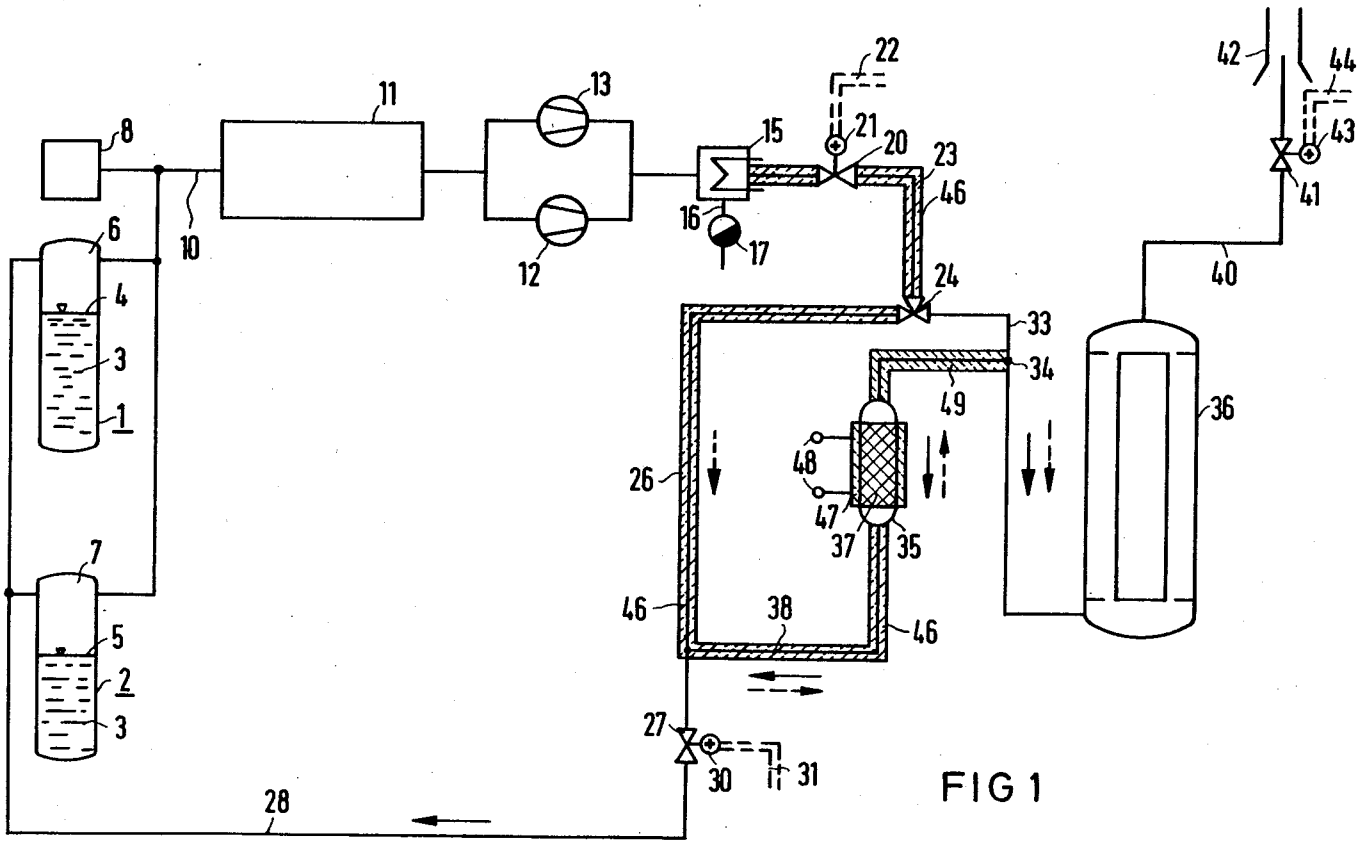

The invention relates to a method for operating a nuclear reactor, with an exhaust gas source, particularly a coolant purifier, and an exhaust gas system connected thereto, including at least one compressor, a gas cooler, a reducing valve, a humidity adsorber, a delay line and a flue connection.

German Patent DE-PS No. 23 02 905, corresponding to U.S. Pat. No. 3,964,965, describes a pressurized-water reactor which includes a coolant purification system with a degasification device. The gases separated from the cooling water are first freed of hydrogen by combustion. They are then transported to a drier, in which water is precipitated. The gases are then segregated in a gas segregation plant by fractional liquefication, so that the rare gases, especially krypton and Xenon, can be stored in a small storage tank, while the remaining gases are returned to the system, unless they are discharged through a flue connection.

In other nuclear reactors, the gases are conducted through a delay line, so that their activity can decay. The delay line is either traversed in a cycle or it precedes the flue, as is explained in the book "VGB Kernkraftwerks-Seminar 1970" (VGB Nuclear Power Station Seminar 1970) on pages 43, 44 and 45. However, such procedures are quite expensive.

It is accordingly an object of the invention to provide a method for operating a nuclear reactor, which overcomes the hereinaforementioned disadvantages of the heretofore-known methods of this general type, and to reduce the costs due to the exhaust gas treatment.

With the foregoing and other objects in view there is provided, in accordance with the invention, a method for operating a nuclear reactor having reactor coolant including an exhaust gas source, particularly a coolant purifier, and an exhaust gas system connected to the exhaust gas source, the exhaust gas system having at least one compressor connected to the exhaust gas source, a gas cooler connected to the compressor, a first reducing valve connected to the gas cooler, a switching valve connected to the first reducing valve, a moisture adsorber connected to the switching valve, a delay line normally connected in parallel with the moisture adsorber, a gas loop connected between the moisture adsorber and the compressor, a flue connection set at a given pressure during normal operation, and a second reducing valve connected between the delay line and the flue connection, which comprises interconnecting the delay line and the moisture adsorber in series, setting the flue connection to a pressure at least twice as high as the given pressure, reversing the switching valve thus allowing the exhaust gas to pass from the moisture adsorber to the delay line and then to the flue connection through the second reducing valve, upon the occurence of a coolant displacement and increased exhaust gas production, especially when starting up and shutting down the reactor.

The new method permits a considerable size reduction of the components required for the exhaust gas treatment and a simpler system construction without additional apparatus. The advantages of the retention behavior which are more advantageous with overpressure for short-time operation of high gas production are combined with the time-wise predominant operating phases with low gas production, in which the possibilities of decompression drying by reduction of the operating pressure are utilized for minimizing the cost of the drying devices customary heretofore.

In accordance with another mode of the invention, there is provided a method which comprises thermally insulating and/or cooling or heating the gas chamber, the moisture adsorber and the gas section of the gas system therebetween.

In accordance with a further mode of the invention, there is provided a method which comprises reducing pressure over a period of several hours after an increased production of exhaust gases. This has been found to be advantageous for the transition from one mode of operation (increased exhaust gas production) to the other (normal operation).

In accordance with a concomitant mode of the invention, there is provided a method which comprises switching over the moisture adsorber into the gas loop leading to the compressor after reaching a given low operating pressure.

Other features which are considered as characteristic for the invention are set forth in the appended claims.

Although the invention is illustrated and described herein as embodied in a method for operating a nuclear reactor, it is nevertheless not intended to be limited to the details shown, since various modifications may be made therein without departing from the spirit of the invention and within the scope and range of equivalents of the claims.

Figure 2:
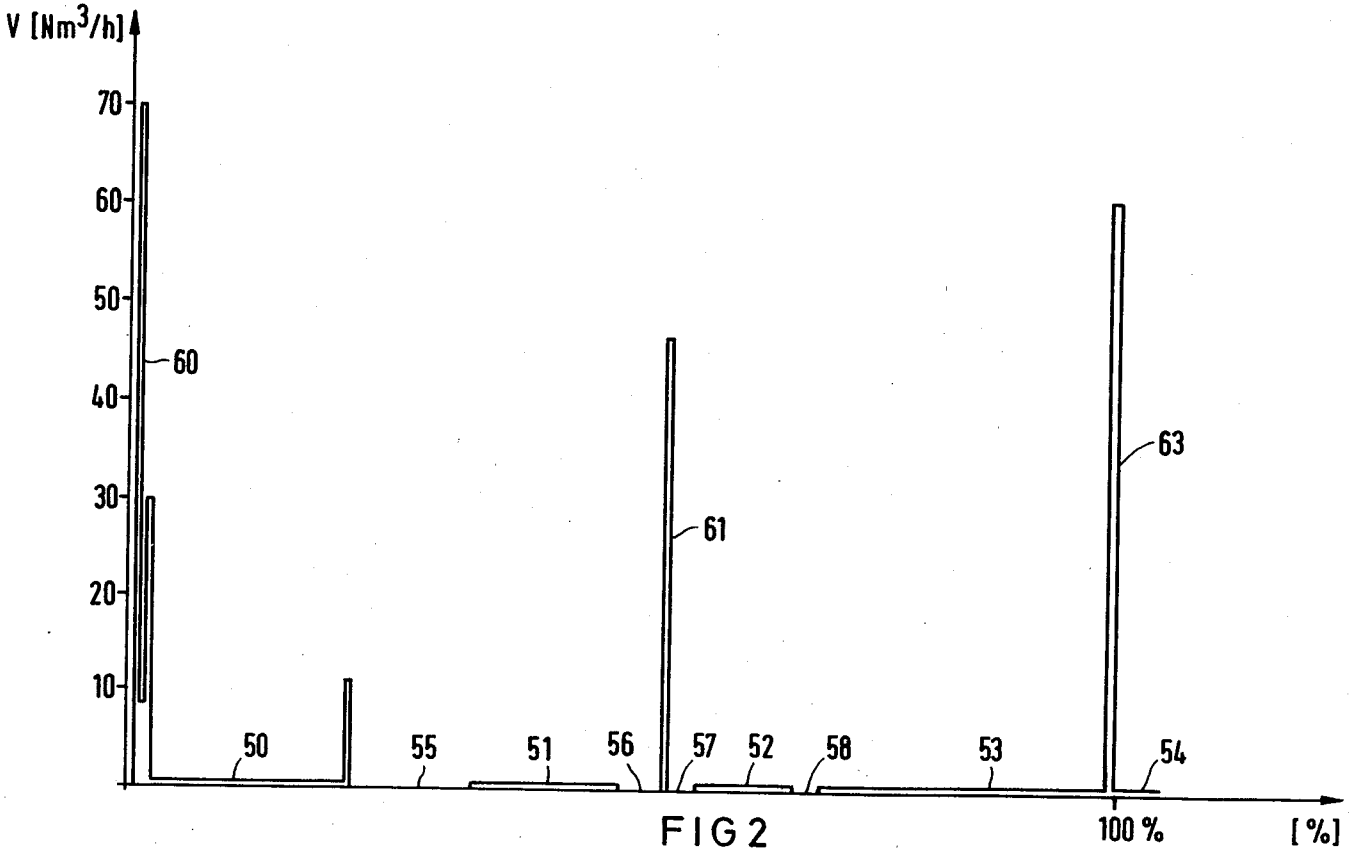

The invention, however, together with additional objects and advantages thereof will be best understood from the following description when read in connection with the accompanying drawings, in which:

FIG. 1 is a greatly simplified schematic and diagrammatic circuit diagram of the exhaust gas system of a pressurized-water reactor with two operating conditions indicated by different arrows with solid and broken lines; and FIG. 2 is a diagram of the characteristic exhaust gas production in $Nm^3/h$ versus time, an operating cycle with an operating time of at least 10 months being designated with 100%.

Referring now to the figures in detail and first particularly to FIG. 1 thereof, there are seen exhaust gas sources which are tanks 1 and 2 containing a liquid having variable liquid levels 4 and 5, and a gas atmosphere 6 and 7 above the liquid level, as well as a degasifier 8. Fission gases are contained in the gas atmosphere 6 and 7 and in the degasifier 8. For this reason, the upper portions of the tanks 1, 2 and the degasifier 8 are connected to an exhaust line 10. The exhaust line 10 leads to a recombiner 11 for $H_2/O_2$. Two compressors 12 and 13 are redundantly connected downstream of the recombiner. The pressure sides of the compressors lead to a gas cooler 15 with a liquid outlet 16 which can be controlled by a condensate discharge 17. It can be seen that the gas cooler is a heat exchanger which may be thermally insulated and may be heated or cooled through the illustrated secondary circuit.

The gas cooler 15 is followed by a reducing valve 20, the control element 21 of which can be actuated over lines 22. The low-pressure side of the reducing valve 20 leads over a line 23 to a switching valve 24. From the switching valve 24, a first line 26 leads to a further reducing valve 27 which is provided for the gas return. The low-pressure outlet of the reducing valve 27 is connected over a line 28 to the gas atmospheres 6, 7 of the exhaust gas tanks 1, 2. The control element 30 of the reducing valve 27 can be actuated by control lines 31. The valve 27 connects the moisture adsorber to the line 28 so it feeds into the gas loop leading to the compressor, after a given low operating pressure is reached.

The other output of the switching valve 24 is connected over a line 33 to a branch 34 which leads on one hand to a humidity adsorber 35 and, on the other hand, to a delay line 36. The moisture or humidity adsorber 35 is a container filled with an adsorbent 37 such as a gel or activated carbon. An outlet 38 of the adsorber 35 leads to the line 26 and therefore to the reducing valve 27.

The delay line 36 is constructed as an activated-carbon tank, having a flow through the tank which is from the bottom up. A flue connection 42 is connected to an outlet 40 of the delay line 36, over a reducing valve 41. The control element 43 of the reducing valve 41 can be actuated by control lines 44.

It should furthermore be pointed out with regard to FIG. 1 that the lines between the gas cooler 15 and the switching valve 24 as well as the line branch 26 and the line 38 up to the outlet of the adsorber 35, are provided with insulation 46 which also encloses cooling means, such as cooling water. The adsorber 35 can carry a cooling jacket 47, which may be in the form of Peltier elements in a circuit having terminals 48. The adsorber 35 may be thermally insulated and heated or cooled by passing a current through the terminals. It is further advantageous for the moisture adsorber 35 to be preceded by a tubular area heater 49 for improving the regeneration. The heater 49 covers the tubular area between the upper region of the moisture adsorber 35 and the branch 34.

As is shown in FIG. 2, the exhaust gas production in the pressurizedwater reactor differs widely. During more than 95% of the operating time, which is the so-called "normal operation", only a small amount of waste with an average of less than 0.5 $Nm^3/h$ is present in the regions 50, 51, 52, 53 and 54 in FIG. 2. In the periods indicated at reference numerals 55, 56, 57 and 58, the exhaust gas production is practically zero. It is only in the remaining 5% of the operating time, that an increased exhaust gas production occurs, which is then, for instance, 100-times the value for several hours. In FIG. 2, this is indicated by the region 60 for the case of a start up and the expansion of the cooling water connected therewith during heating up, which reduces the gas atmosphere volumes 6, 7 in the exhaust gas sources 1 and 2. At the region 61, flushing of the exhaust gas sources, such as before a container is opened, is shown. The region 63 indicates the lowering of the filling level in the reactor pressure vessel, conceivably at the end of the operating cycle, i.e. before the reactor pressure vessel is opened.

The following three operating cycles of the new method can be distinguished:

(1) Extended continuous operation (greater than 95% of the operating time of a pressurized-water reactor). This represents a relatively small production of exhaust gas, for instance, less than 0.5 $Nm^3/h$. This amount of exhaust gas as well as an amount of flushing gas which results from the output capacity of the compressor 12, 13, is compressed by the compression unit in a continuous or discontinuous manner (for instance, $p_e=8$ to 25 bar). In the connected gas cooler 15, which is cooled with cold water, for instance, the cooling and reduction of the absolute gas humidity takes place. In the following reducing valve 20, the gas is expanded with a corresponding reduction of the relative gas humidity (for instance, $p_e=1$ to 4 bar).

The gas which is cooled off slightly due to the expansion and gas cooling is then warmed up to room temperature by the ambient air through appropriate placement of the piping and other auxiliary devices.

After passing the three-way valve 24, the exhaust gas is divided into two gas streams in the branch 34. Only the excess exhaust gas (for instance, less than 0.5 $Nm^3/h$) is conducted through the delay line 36; the rest is returned to the compressor intake side through the moisture adsorber 35 for regeneration. The gas adsorption which proceeds in the delay line 36 at reduced operating pressure, may produce the desired time delay in the first quarter of the adsorber in spite of the reduced adsorption effect due to small exhaust gas production. In this way, the remaining part is available for other modes of operation.

(2) The gas displacement mode occurs in pressurized-water reactor systems almost exclusively during start up and the lowering of the reactor pressure vessel filling level as well as during flushing operation of the primary loop that might follow.

During this operating mode, the delay line 36 is operated at increased operating pressure. For several hours the exhaust gas production therefore exceeds the above-mentioned continuous exhaust gas production by 100 times, for instance. The gas moves in the direction of the dotted arrows during this increased pressure in the delay line and increased exhaust gas production.

The increase of the operating pressure distinctly improves the retention capacity of the delay line 36, besides providing the additional gas storage caused by the pressure increase.

Depending on the exact operating conditions, a delay effect improved 2 to 3-times is achieved at $p_e=8$ to 25 bar for Xe-isotopes, and for the Kr isotopes which are relevant in this operating mode (because of the shorter adsorber breakthrough time) a delay effect improved about 3 to 5-times is achieved.

The exact gas dehumidification is carried out in this mode of operating of the delay line in the preceding moisture adsorber 35 by switching the valve 24. For this mode of operation, which determines the layout, the part of the delay line 36 which has heretofore been practically ineffective for reducing the activity, is now utilized under optimum conditions.

(3) Operation directly following the displacement gas mode. The amount of exhaust gas produced drops again to values, of less than 0.5 $Nm^3/h$, for instance. The increased operating pressure is maintained for a short time in order to sufficiently delay the rare gas isotopes with relevant activity as well, shortly before leaving the delay line 36 (for instance, Kr 85 m at 5 to 10 MHz≙21.5 to 43 h).

Conservatively speaking, the slow lowering of the operating pressure then takes place after 40 hours, for instance, by increasing the amount given off to a fixed value, to the design or starting value, so that a corresponding reduction of the operating pressure is obtained, such as over about 10 hours, because of the small exhaust gas production.

The moisture adsorber 35 which previously operated as a gas drier for the purpose of regeneration, is switched over beginning with the point in time at which the lowered operating pressure is reached. Then, the heater 49 can be switched on and the insulation 46 in the vicinity of the line 38 can be put in place.

The foregoing is a description corresponding in substance to German Application No. P 33 34 629.1, filed Sept. 24, 1983, the International priority of which is being claimed for the instant application, and which is hereby made part of this application. Any material discrepancies between the foregoing specification and the aforementioned corresponding German application are to be resolved in favor of the latter.

What is claimed is:

1. Method for operating a nuclear reactor having reactor coolant including an exhaust gas source and an exhaust gas system connected to the exhaust gas source, the exhaust gas system having at least one compressor connected to the exhaust gas source, a gas cooler connected to the compressor, a first reducing valve connected to the gas cooler, a switching valve connected to the first reducing valve, a moisture adsorber connected to the switching valve, a delay line normally connected in parallel with the moisture adsorber, a gas loop connected between the moisture adsorber and the compressor, a flue connection set at a given pressure during normal operation, and a second reducing valve connected between the delay line and the flue connection, which comprises interconnecting the delay line and the moisture adsorber in series, setting the flue connection to a pressure at least twice as high as the given pressure, reversing the switching valve thus allowing the exhaust gas to pass from the moisture adsorber to the delay line and then to the flue connection through the second reducing valve, upon the occurrence of a change in volume of the coolant of the nuclear reactor and increased exhaust gas production.

2. Method according to claim 1, which comprises carrying out the steps of interconnecting the delay line and the moisture adsorber in series, setting the flue connection to a pressure at least twice as high as the given pressure, and connecting the delay line to the flue connection through the second reducing valve, upon starting up the reactor.

3. Method according to claim 1, which comprises carrying out the steps of interconnecting the delay line and the moisture adsorber in series, setting the flue connection to a pressure at least twice as high as the given pressure, and connecting the delay line to the flue connection through the second reducing valve, upon shutting down the reactor.

4. Method according to claim 1, which comprises thermally insulating the gas cooler, the moisture adsorber and the section of the gas system therebetween.

5. Method according to claim 1, which comprises thermally insulating and heating the gas cooler, the moisture adsorber and the section of the gas system therebetween.

6. Method according to claim 1, which comprises thermally insulating and cooling the gas cooler, the moisture adsorber and the section of the gas system therebetween.

7. Method according to claim 1, which comprises heating the gas cooler, the moisture adsorber and the section of the gas system therebetween.

8. Method according to claim 1, which comprises cooling the gas cooler, the moisture adsorber and the section of the gas system therebetween.

9. Method according to claim 1, which comprises reducing pressure in the delay line over a period of several hours after an increased production of exhaust gases.

10. Method according to claim 9, which comprises switching over the moisture adsorber into the gas loop leading to the compressor after reaching a given low operating pressure.

* * * * *